US005136908A

United States Patent [19]

Callandrello

[11] Patent Number: 5,136,908

[45] Date of Patent: Aug. 11, 1992

[54] FOOD SLICER APPARATUS AND KNIFE THEREFOR

[75] Inventor: Joseph Callandrello, Lyndhurst, N.J.

[73] Assignee: Valley Slicer Co., Lyndhurst, N.J.

[21] Appl. No.: 737,454

[22] Filed: Jul. 29, 1991

[51] Int. Cl.[5] ..... B26D 1/153

[52] U.S. Cl. ..... 83/703; 83/402; 83/666; 83/676

[58] Field of Search ..... 83/703, 707, 402, 171, 83/666, 676

[56] References Cited

U.S. PATENT DOCUMENTS

| | | | |
|---|---|---|---|
| 714,359 | 11/1902 | Brooks | 83/676 |
| 1,825,712 | 10/1931 | Campbell | 83/676 |
| 2,055,818 | 9/1936 | Folk | 83/676 |

*Primary Examiner*—Hien H. Phan

*Attorney, Agent, or Firm*—Siegmar Silber

[57] ABSTRACT

A food slicing machine with a circular knife having a plurality of radially spaced indentations on a portion inwardly of the cutting edge to induce air flow during rotation of the knife to prevent food particles from accumulating on the knife during cutting operation.

20 Claims, 3 Drawing Sheets

FOOD SLICER APPARATUS AND KNIFE THEREFOR

BACKGROUND OF THE INVENTION

1. Field of the Invention

This invention relates to a food slicer apparatus and a knife therefor and, more particularly to a knife that disturbs the airflow adjacent the perimeter thereof and precludes the buildup of food particulates on the knife surface.

2. Information Disclosure Statement

In preparing for this application, a pre-examination patentability search was conducted. In performing the search, the following fields and periods covered by the search were examined.

| CLASS/SUBCLASS | PERIOD COVERED |
|---|---|
| 30/347 | 03/19/1907 to 05/28/1991 |
| 83/676 | 06/27/1839 to 01/15/1991 |

The search, which reviewed several subclasses of Classes 38 and 83, uncovered the following patents:

| ITEM NO. | U.S. PAT. NO. | INVENTOR | ISSUE DATE |
|---|---|---|---|
| 1 | 1,120,270 | A. Brussolo | 12/08/1914 |
| 2 | 1,630,945 | A. Jacobowitz | 05/31/1927 |
| 3 | 2,531,841 | F. J. Cashin | 11/28/1950 |
| 4 | 2,735,468 | X. B. K. Green et al. | 02/21/1956 |
| 5 | 3,872,763 | I. Kayahara | 03/25/1975 |
| 6 | 4,891,885 | R. R. Fischer et al. | 01/09/1990 |

In considering the various patents uncovered, the patent to Brussolo '270 teaches a slicer blade having the general profile of that of the common slicer blade. Brussolo '270 further teaches an edge formed by closely spaced grooves with those on the front face alternating with those on the back face with the purpose of maintaining knife sharpness. The patent to Cashin, Cashin '841, is a variant of this, in that a knife for a book block trimmer has V-shaped grooves about the perimeter. Here the purpose is the ejection of debris from the cutting site. This teaching is the antithesis of the disclosure at hand insofar as the present disclosure teaches a means of separating the knife from the food being cut.

Next items 5 and 6 above, namely, Kayahara '763 and Fischer '885 are considered. The knife of Fischer '885 is of interest as detail in FIGS. 8 and 9 thereof. The Kayahara '763 patent shows a series of apertures in an annular configuration arrayed along the outer portion of the saw blade adjacent the cutting edge. In both of these patents, the teachings are for different purposes than those of the present disclosure, to wit, in the case of the scalloped edge, to maintain sharpness; and in the case of the apertured edge, to maintain thermal stability. Here again there is no application or teaching toward a food slicer of the type presented hereinbelow.

In the past, food slicing machines, especially of the gravity-fed type, experience when slicing gummy or greasy foods, such as cheeses or meats, the accumulation of waste particulate matter in the area adjacent the cutting edge of the knife. This condition is often exacerbated during the back stroke of the reciprocating chute.

SUMMARY

In general terms, the invention disclosed hereby includes a food slicing apparatus with a gravity feed chute for reciprocally carrying food being sliced across a rotating, food-shedding knife. The food-shedding knife is characterized by indentations in an apron portion—behind the peripheral cutting edge and on the front of the knife—so that upon rotation of the knife, the indentations disturb the adjacent airflow. The apparatus includes a base; a drive motor mounted on the base, which drive motor has an output shaft; a transmission for transmitting rotatory motion from the output shaft to the knife; a knife plate or hub assembly for mounting the knife; and, a knife with a dish-shaped body. In the apparatus form of the disclosure, the food slicer operates so that, when food in the gravity feed chute is reciprocally moved across the rotating knife, the food is sliced without food particles building up on the knife surface. The disclosure further includes a food slicer knife with indentations arrayed on the apron portion. The indentations are sufficiently large, that during the rotation of the knife, the air passing along the surface of the apron portion is disturbed. It has been found that the arrangement of the knife as described in detail hereinbelow is especially useful in preventing buildup of cheese and meat particles on the knife.

OBJECT AND FEATURES OF THE INVENTION

It is an object of the present invention to provide a food slicer knife which provides turbulent airflow adjacent the cutting edge.

It is a further object of the present invention to provide a food slicer knife which prevents the buildup of food debris thereon.

It is yet another object of the present invention to provide a food slicer knife with a continuous smooth cutting edge and medial intrafacial indentations.

It is still yet another object of the present invention to provide a food slicer knife wherein the indentations are air spoilers.

It is a feature of the present invention that the irregular surface adjacent the cutting edge of the food slicer knife creates turbulent airflow.

It is another feature of the present invention to have a food slicer knife that minimizes food buildup thereon.

Other objects and features of the invention will become apparent upon review of the drawings and the detailed description which follow.

BRIEF DESCRIPTION OF THE DRAWINGS

In the following drawings, the same parts in the various views are afforded the same reference designators.

DESCRIPTION OF THE PREFERRED EMBODIMENT

Figure 1:
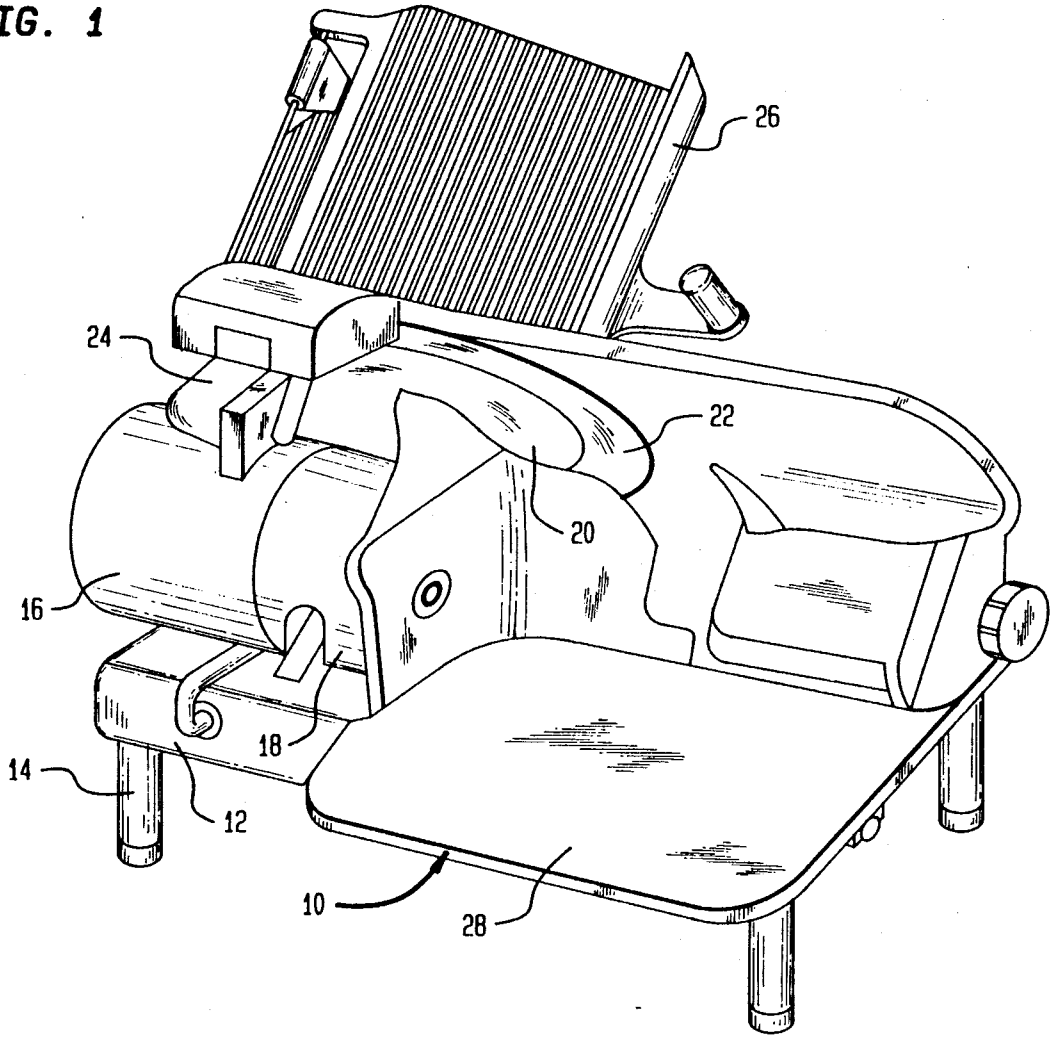
FIG. 1 is a simplified perspective view of the food slicing apparatus of the present invention.

The following description provides the details of an improvement to the art of the food slicer apparatus and to the knife therefor. In the description, the food slicer is referred to generally by the numeral 10. While context in which this improvement is described is that of the semi-automatic gravity-feed food slicer common to delicatessens and other food retail outlets, the knife is applicable to automatic feed slicers and slicers other than gravity-feed units. These food slicers are marketed under the "Globe", "Hobart", "Berkel", or "Fleetwood" trademarks with exemplary models thereof being the Globe Food Slicer Model 500L, Globe Food Equipment Co., Dayton, Ohio and Hobart Food Slicer Model 1612, Hobart, Inc., Troy, Ohio. Although these machines have evolved over the past eighty years, there has been limited industry-wide standardization and, therefore, the knives for each manufacturer differ slightly. Referring now to FIG. 1, the food slicer 10 is constructed with a base 12, in turn supported by legs 14. A single-ended drive motor 16 is mounted on the base 12 with the drive shaft thereof being connected to gear housing 18. This housing is constructed to include a drive mechanism for transmitting the rotatory motion to the slicer. To the drive mechanism, a knife plate or knife-receiving portion 20 is attached and, in turn, a knife 22 is mounted thereon. About the periphery of the knife, a knifeguard 24 is emplaced so that workers will not be unduly exposed to the rotating knife during slicing operations. The slicer 10 further is constructed to include a gravity-feed chute 26 which is mounted for reciprocal movement in a plane substantially parallel to the knife plate 20 and thereby to present food for slicing to the knife. In addition, a slice receiving tray 28 is mounted on the base and is provided to receive slices of food exiting from the rotating knife.

Figure 3:
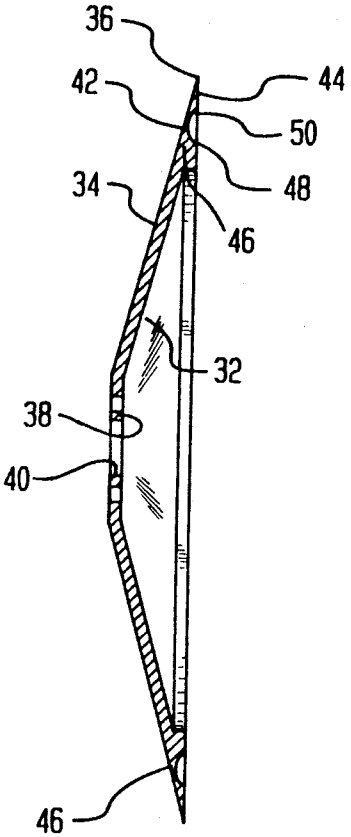
FIG. 3 is a cross-sectional view of the invention shown in FIG. 2, said view taken along line 3—3 thereof and showing the knife profile.
Figure 2:
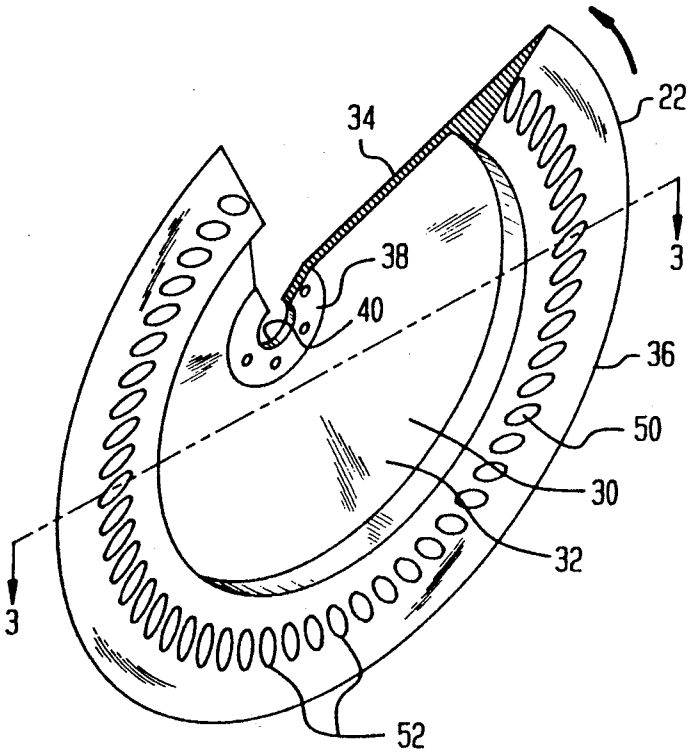
FIG. 2 is a perspective view of the knife for the food slicing apparatus of the present invention, and is shown partially broken away to show greater detail.

Referring now to FIGS. 2 and 3, the structure of the knife 22 is next discussed. The knife or airflow knife 22 is constructed from food-grade stainless steel suitable for high-speed rotary blade fabrication. The knife 22 is structured with a base 30 which is a dish-shaped or disk-like body having a concave or front side 32 and a convex or back side 34. The outermost or cutting edge 36 of the knife 22 is constructed to be ground from the back and honed or deburred from the front. Thus, in the trade, the back side 34 is also referred to as the "grinding" side, and, conversely, the front side 32 of the knife, as the "trueing" side. The central interior portion of the knife 22 is constructed as a knife hub 38 for attachment to the knife plate 20. The knife hub 38 has a flat outer hub surface 40 for mating purposes. From the cutting edge 36, the cutting knife portion 42 extends radially inwardly with the upper surface 44 thereof being along a plane substantially parallel to that of hub surface 40. The upper surface 44 is also extended radially inwardly to form an apron portion or spoiler member 46 contiguous with the cutting knife portion 42 with the upper surface 48 thereof being coplanar with the face of the cutting knife portion. Medial the apron portion 46 is a plurality of indentations 50. The indentations 50 are sufficiently deep so that, during rotatory motion of the food slicer knife, the air flowing along the surface of the apron portion is disturbed. In the best mode of practicing the invention, it has been found that a row of ellipse-shaped indentations 50, described in greater detail below is efficacious. While this shape has been chosen, any shaped indentation that would disturb the airflow could be formed into the apron portion. Here the only limitations are the pragmatic aspects of: (1) machinability; (2) cleanability; and, (3) structural integrity of the knife.

Figure 4:
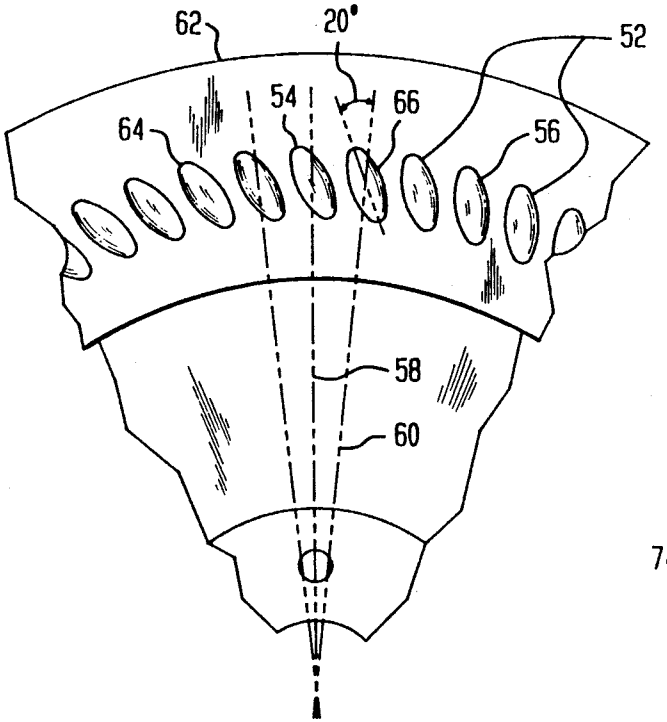
FIG. 4 is a detailed perspective view of one of the intrafacial indentations of the food slicer knife showing the canted position thereof and its position relative to the knife radius and the direction of rotation; and, FIG. 5 is an operational schematic view of the invention showing food being sliced by a food slicer knife of this invention and providing arrows representing airflow patterns.

Referring now to FIG. 4, the indentations 50 are now described. In the disclosure at hand, the indentations 50 are shown in an array 52 of seventy two ellipsoidal wells 54. Adjacent wells 54 and 56 are shown spaced 5° apart on the apron portion 46 and on knife radii 58 and 60. The wells 54 and 56 are canted approximately 20°, that is the knife radius to the center of the well is at 20° (approx.) to the major axis 62 of the elliptical opening 64 in the surface of the apron portion. The wells 54 and 56, which, by way of example, are dimensioned with the elliptical opening 64 having a major axis 62 of 1.5 cm (approx.) and a minor axis 66 of 0.6 cm (approx.) and with a depth of 0.3 cm (approx.), have been found sufficient to disturb the air boundary about the apron portion 46. Although the airflow about the knife and the indentations is not completely understood, the structure is such that, upon the slicer chute return stroke, instead of food particles and strands agglomerating on the apron portion as occurs with a standard knife, with the airflow knife the food particles and strands are forced or maintained at a spaced distance from the apron surface.

Figure 5:
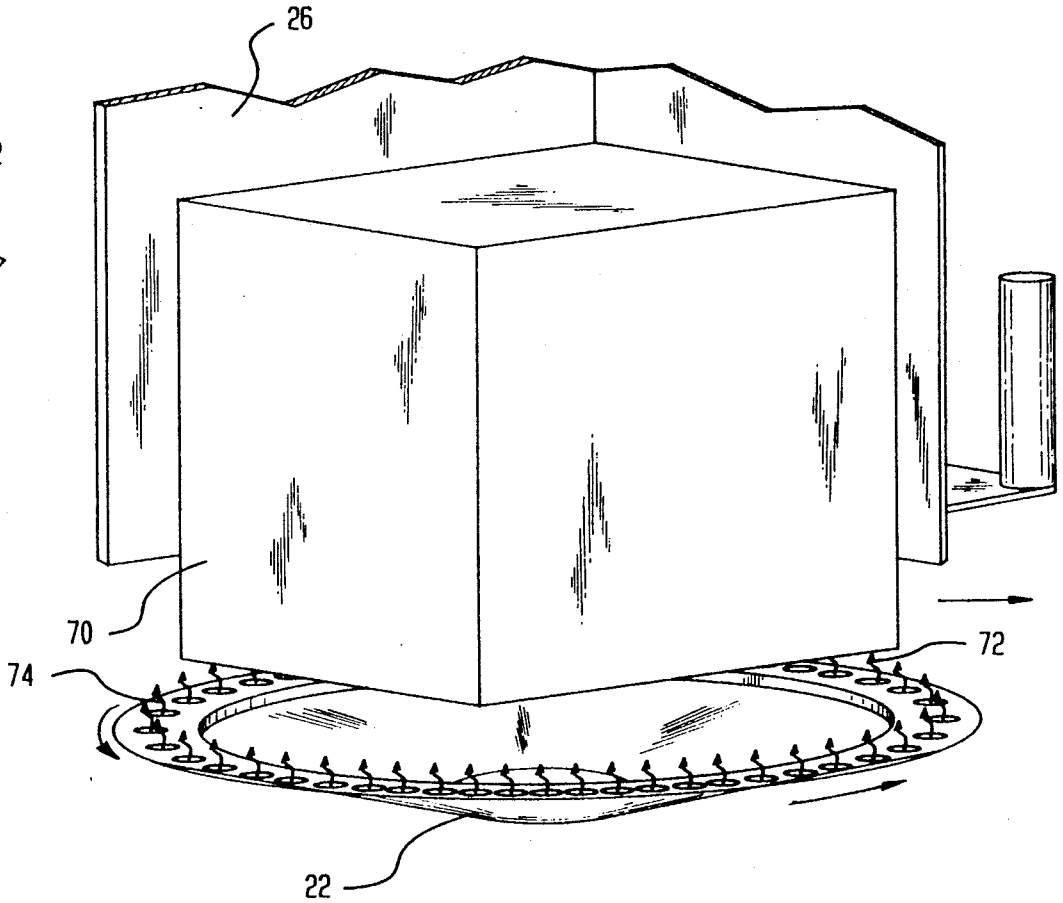

Referring now to FIG. 5, the operation is next described. A loaf of cheese 70 is placed in the gravity-feed chute 26 and is moved back and forth across the rotating knife 22. As the knife 22, configured as hereinabove described rotates, the indentations 50 act as air spoilers. The resultant turbulence, denoted by airflow arrows 72 and 74, is sufficient so that during the chute 26 return stroke—that is returning from the chute travel limit after a slice has been cut—the loaf of cheese is not pressed against the knife 22. Thus, the return stroke occurs without food particles or strands building up on the face of the knife adjacent the cutting edge.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A food slicer knife for a food slicer having a drive means for rotatory operation of said knife and a food chute for moving the food-being-sliced back and forth across the rotating knife, said knife comprising:

a dish-shaped base having a knife hub at the center thereof for mounting the knife onto the food slicer, said base having a concave front and a convex back;

a cutting knife portion extending radially outwardly from said dish-shaped base forming a continuous, smooth cutting edge at the perimeter thereof;

an apron portion contiguous with said cutting knife portion and extending inwardly on the front of the knife with the face thereof forming a continuous surface with the face of said cutting knife portion; and, a plurality of indentations medial the apron portion, said indentations, during the rotation of the knife, being sufficiently large to disturb the air at the surface of the apron portion;

whereby, upon operation, when food-being-sliced is moved back and forth across the rotating knife, the food is sliced without food particles accumulating on the knife surface during the backward and forward motion thereof.

2. A knife as described in claim 1 wherein said indentations further comprise an array of indentations forming a symmetrical pattern about the central axis of the knife.

3. A knife as described in claim 2 wherein said array of indentations maintains the dynamic balance of the airflow knife.

4. A knife as described in claim 3 wherein said indentations are smooth-walled wells gradually sloping from the surface of the said apron portion.

5. A knife as described in claim 3 wherein said indentations are spaced at predetermined radial positions.

6. An airflow knife for a food slicer, said food slicer having a drive motor and drive hub for rotatory operation of the knife, said airflow knife comprising:

a disk-like base having a flat knife hub at the center thereof for mounting the airflow knife onto said drive hub, said base having a concave front and a convex back;

a cutting knife portion extending radially outwardly from said base forming a cutting edge at the perimeter thereof;

an air-spoiler portion contiguous with said cutting knife portion and extending inwardly on the front of the airflow knife with the face thereof forming a continuous surface with the face of said cutting knife portion; and, a plurality of ellipsoidal indentations medial the air-spoiler portion and arranged symmetrically thereabout, said indentation, during operation of the food slicer, causing turbulence at the surface of the front of the knife;

whereby, during rotatory operation of said knife, airflow is induced along the face of the air-spoiling portion sufficient to separate food-being-sliced from the surface of the knife.

7. An airflow knife as described in claim 6 wherein said indentations are smooth-walled and gradually sloping from the surface of the said apron portion.

8. An airflow knife as described in claim 7 wherein said indentations are spaced at predetermined radial positions.

9. An airflow knife as described in claim 8 wherein said radial positions are at 5° intervals.

10. An airflow knife as described in claim 8 wherein said indentations are ellipsoidal segments and are canted in the direction of rotation.

11. An airflow knife as described in claim 10 wherein said ellipsoidal segments intersect the surface of said apron portion at substantially elliptical openings.

12. An airflow knife as described in claim 11 wherein the major axis of each elliptical opening forms approximately a 20° angle with the bisecting knife radius.

13. A food slicing apparatus with a gravity feed chute for reciprocal operation across a rotating knife, said apparatus comprising:

a base;

a drive motor mounted on said base, said drive motor having an output shaft;

knife drive means for transmitting rotatory motion from said drive motor, said drive means attached to the output shaft of said drive motor;

a knife plate assembly mounted to said knife drive means having a knife-receiving portion;

a knife with a dish-shaped body attached to said knife-receiving portion of said knife plate assembly, said knife, in turn, comprising:

a cutting knife portion extending radially outwardly from said dish-shaped base forming a continuous smooth cutting edge at the perimeter thereof;

an apron portion contiguous with said cutting knife portion and extending inwardly on the front of the airflow knife with the face thereof forming a continuous surface with the face of said cutting knife portion; and, a plurality of indentations medial the apron portion, said indentations having sufficient depth to disturb the air thereabout;

a knife guard surrounding and adjacent said knife; and, a slice receiving tray mounted on said base;

whereby, upon operation, food in the gravity feed chute is reciprocally moved across the rotating knife and is sliced without buildup of food particles on the knife surface.

14. A food slicing apparatus as described in claim 13 wherein said indentations further comprise an array of indentations forming a symmetrical pattern about the central axis of the knife.

15. A food slicing apparatus as described in claim 14 wherein said array of indentations maintains the dynamic balance of the airflow knife.

16. A food slicing apparatus as described in claim 15 wherein said indentations are smooth-walled wells gradually sloping from the surface of the said apron portion.

17. A food slicing apparatus as described in claim 15 wherein said indentations are spaced at predetermined radial positions.

18. A food slicing apparatus as described in claim 17 wherein said radial positions are at 5° intervals.

19. A food slicing apparatus as described in claim 17 wherein said indentations are ellipsoidal segments and are canted in the direction of rotation.

20. A food slicing apparatus as described in claim 19 wherein said ellipsoidal segments intersect the surface of said apron portion at substantially elliptical openings.

* * * * *